US006993925B2

(12) United States Patent
Duffy

(10) Patent No.: US 6,993,925 B2
(45) Date of Patent: Feb. 7, 2006

(54) REFRIGERATED MERCHANDISER WITH ACCESS FOR CLEANING

(75) Inventor: Martin J. Duffy, University City, MO (US)

(73) Assignee: Hussmann Corporation, Bridgeton, MO (US)

( * ) Notice: Subject to any disclaimer, the term of this patent is extended or adjusted under 35 U.S.C. 154(b) by 3 days.

(21) Appl. No.: 10/792,451

(22) Filed: Mar. 3, 2004

(65) Prior Publication Data

US 2005/0193755 A1 Sep. 8, 2005

(51) Int. Cl.
*A47F 3/04* (2006.01)

(52) U.S. Cl. ..... 62/249; 62/303; 62/285

(58) Field of Classification Search ..... 62/246–256, 62/303, 382, 298, 285–291, 419, 426; 312/138.1, 312/211, 404, 408, 402
See application file for complete search history.

(56) References Cited

U.S. PATENT DOCUMENTS

| | | | | |
|---|---|---|---|---|
| 1,712,896 | A | | 5/1929 | Moorehead |
| 2,074,375 | A | | 3/1937 | Dick |
| 2,158,447 | A | | 5/1939 | Whitsett |
| 2,181,635 | A | | 11/1939 | Tull |
| 2,279,945 | A | * | 4/1942 | Hoffman ..... 312/107 |
| 2,463,614 | A | | 3/1949 | Hardin |
| 2,508,255 | A | | 5/1950 | Hardin |
| 2,624,649 | A | * | 1/1953 | Greiling ..... 312/107 |
| 3,031,862 | A | * | 5/1962 | Sherron ..... 62/259.1 |
| 3,561,230 | A | | 2/1971 | Gatton et al. |
| 3,675,440 | A | | 7/1972 | Ibrahim |
| 3,696,630 | A | | 10/1972 | Bressickello |
| 4,135,369 | A | * | 1/1979 | Allgeyer et al. ..... 62/251 |
| 4,367,632 | A | | 1/1983 | Ibrahim et al. |
| 4,370,866 | A | | 2/1983 | Abraham |
| 4,648,247 | A | * | 3/1987 | Takizawa et al. ..... 62/256 |
| 4,949,554 | A | * | 8/1990 | Branz et al. ..... 62/248 |
| 5,366,285 | A | * | 11/1994 | Borgen et al. ..... 312/404 |
| 5,475,988 | A | | 12/1995 | McGovern |
| 5,502,979 | A | * | 4/1996 | Renard ..... 62/256 |
| 6,685,051 | B2 | * | 2/2004 | Zangari et al. ..... 221/67 |

FOREIGN PATENT DOCUMENTS

| | | |
|---|---|---|
| EP | 0291381 | 11/1988 |

* cited by examiner

*Primary Examiner*—William E Tapolcai
(74) *Attorney, Agent, or Firm*—Michael Best & Friedrich LLP

(57) ABSTRACT

A refrigerated merchandiser adapted to display refrigerated products includes a case defining a product display area, a bottom shelf adapted to support the refrigerated products within the product display area, and a container removably coupled with the case at a location below the bottom shelf and adapted to collect debris falling below the bottom shelf. The container is removable from the case for cleaning without removing the refrigerated products from the bottom shelf.

21 Claims, 5 Drawing Sheets

REFRIGERATED MERCHANDISER WITH ACCESS FOR CLEANING

FIELD OF THE INVENTION

This invention relates generally to display cases, and more particularly to refrigerated display cases.

BACKGROUND OF THE INVENTION

In conventional practice, supermarkets and convenience stores are equipped with refrigerated merchandisers, which may be open or provided with doors, for presenting fresh food or beverages to customers while maintaining the fresh food and beverages in a refrigerated environment. Typically, cold, moisture-bearing air is provided to a product display area of the merchandiser by passing an airflow over the heat exchange surface of an evaporator coil, or evaporator. A suitable refrigerant is passed through the evaporator, and as the refrigerant evaporates while passing through the evaporator, heat is absorbed from the air passing through the evaporator. A suitable secondary refrigerant (e.g., glycol) may also be used in place of the evaporative refrigerant. As a result, the temperature of the air passing through the evaporator is lowered for introduction into the product display area of the merchandiser.

Such a prior-art refrigerated merchandiser 10 is shown in FIG. 1. The merchandiser 10 includes a case 14 generally defining an interior bottom wall or shelf 18, an interior rear wall 22, and an interior top wall 26. The area bounded by the interior bottom wall 18, interior rear wall 22, and the interior top wall 26 defines a product display area 30, in which the fresh food and/or beverages are stored on one or more shelves 32. The case 14 includes an open front face to allow customers access to the fresh food and/or beverages stored in the case 14.

The case 14 also generally defines an exterior bottom wall 34 adjacent the interior bottom shelf 18, an exterior rear wall 38 adjacent the interior rear wall 22, and an exterior top wall 42 adjacent the interior top wall 26. A lower flue 46 is defined between the interior bottom shelf 18 and the exterior bottom wall 34 to allow for substantially horizontal airflow throughout the lower flue 46. The interior bottom shelf 18 includes an opening 50 to communicate with the lower flue 46 to allow surrounding air to be drawn into the lower flue 46 from the product display area 30. A rear flue 54 is defined between the interior and exterior rear walls 22, 38 and is fluidly connected with and adjacent to the lower flue 46. The rear flue 54 allows for substantially vertical airflow throughout the rear flue 54. An upper flue 58 is defined between the interior and exterior top walls 26, 42 and is fluidly connected with and adjacent to the rear flue 54. The upper flue 58 allows for substantially horizontal airflow throughout the upper flue 58. The interior top wall 26 includes an opening 62 to communicate with the upper flue 58 to allow airflow in the upper flue 58 to be discharged from the upper flue 58 and into the product display area 30. When combined, the lower flue 46, the rear flue 54, and the upper flue 58 comprise an air passage separate from the product display area 30.

The refrigerated merchandiser 10 also includes some components of a refrigeration system (not entirely shown) therein. One or more fans 66 are located within the lower flue 46 toward the back of the case 14 to generate an airflow through the lower, rear, and upper flues 46, 54, 58. An evaporator 70 is located within the rear flue 54 toward the bottom of the case 14. The evaporator 70 is positioned downstream of the fans 66 such that the airflow generated by the fans 66 passes through the evaporator 70. The refrigeration system may also include other components (not shown), such as one or more compressors, one or more condensers, a receiver, and one or more expansion valves, all of which may be remotely located from the refrigerated merchandiser 10.

For optimal performance, retailers should maintain their merchandisers 10, especially self-service dairy, deli, meat, and produce merchandisers 10, at a high level of sanitation. This usually comes at high costs and/or difficulty to the retailer. For example, in conventional merchandisers 10, the shelf 18, must be removed to access the bottom of the case 14 for cleaning. This also requires removal and storage of the products supported on the bottom shelf. With reference to FIG. 1, the merchandiser 10 includes a foam tub 74 below the interior bottom wall 18 to substantially insulate the bottom of the case 14. The foam tub 74 also presents several problems to retailers when attempting to clean their merchandisers 10. For example, in conventional merchandisers 10, the foam tub 74 restricts access to the ground or support surface supporting the merchandiser 10, which makes cleaning the area beneath the merchandisers 10 difficult.

Repairing and/or replacing the fans 66 in the merchandiser 10 is also a difficult and labor-intensive process. To gain access to the fans 66, the products situated on the bottom shelf 18 must be removed and then the bottom shelf 18 must be removed. This is especially problematic when having to troubleshoot a single malfunctioning fan 66 in the merchandiser 10, which may require the removal of more than one bottom shelf 18 in the merchandiser 10.

SUMMARY OF THE INVENTION

The present invention provides, in one aspect, a refrigerated merchandiser adapted to display refrigerated products. The merchandiser includes a case defining a product display area, a bottom shelf adapted to support the refrigerated products within the product display area, and a container removably coupled with the case at a location below the bottom shelf and adapted to collect debris falling below the bottom shelf. The container is removable from the case for cleaning without removing the refrigerated products from the bottom shelf.

The present invention provides, in another aspect, a refrigerated merchandiser adapted to display refrigerated products. The merchandiser includes a case defining a product display area, a bottom shelf adapted to support the refrigerated products within the product display area, and a first insulating panel coupled to the case. The first insulating panel has a lower end in contact with a support surface supporting the case. The merchandiser also includes a second insulating panel coupled to the case opposite the first insulating panel. The second insulating panel has a lower end in contact with the support surface such that a space is defined by the bottom shelf, the support surface, and the first and second insulating panels.

The present invention provides, in yet another aspect, a refrigerated merchandiser adapted to display refrigerated products. The merchandiser includes a case defining a product display area, a bottom shelf adapted to support the refrigerated products within the product display area, a fan supported by the case below the bottom shelf and operable to generate an airflow in the case and through the product display area, and a panel movably coupled with the case.

The panel is selectively movable to allow access to the fan for maintenance without removing the refrigerated products from the bottom shelf.

Other features and aspects of the present invention will become apparent to those skilled in the art upon review of the following detailed description, claims, and drawings.

BRIEF DESCRIPTION OF THE DRAWINGS

In the drawings, wherein like reference numerals indicate like parts.

Figure 1:
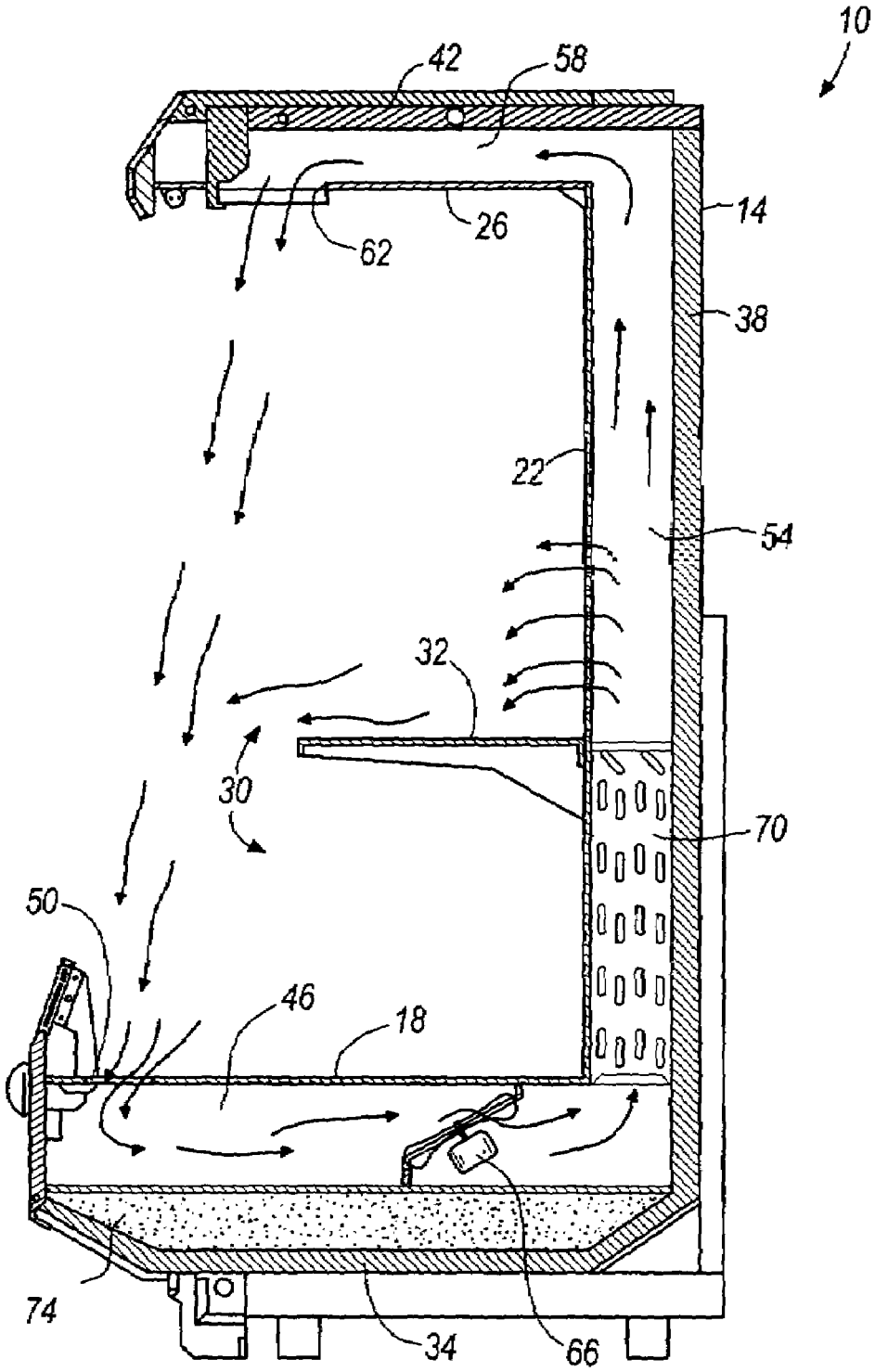
FIG. 1 PRIOR ART
FIG. 1 is a cross-sectional view of a prior-art refrigerated merchandiser.

Before any features of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 2:
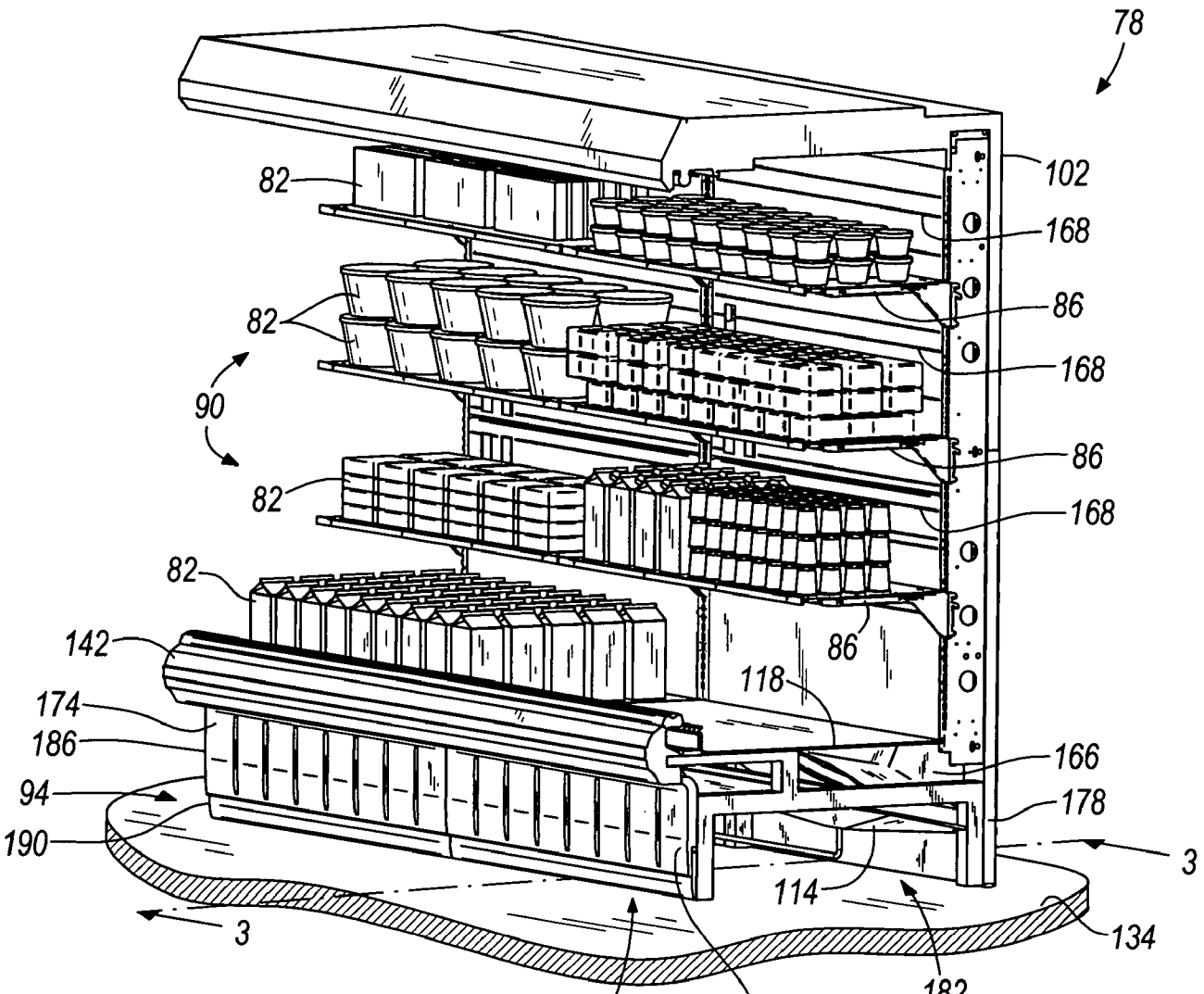
FIG. 2 is a perspective view of a refrigerated merchandiser of the present invention.

FIG. 2 illustrates a refrigerated merchandiser 78 of the present invention. The merchandiser 78 may contain a variety of products 82 situated on one or more shelves 86 in a product display area 90. The merchandiser 78 may comprise a medium temperature merchandiser, in which the air temperature in the product display area 90 is maintained within a standard temperature range of 32° F. to 41° F. Such merchandisers 78 may include, for example, meat merchandisers, deli and dairy merchandisers, and produce merchandisers. Alternatively, the merchandiser 78 may comprise a low temperature merchandiser, in which the air temperature in the product display area 90 is maintained at a temperature below 32° F. Such a merchandiser 78 may include, for example, a reach-in frozen food merchandiser.

The merchandiser 78 of FIG. 2 is comprised of two interconnected modules 94. Each module 94 generally includes a case 102 having its own set of refrigeration components (e.g., an evaporator 106, one or more fans 110, and a drain pan 114 positioned below the evaporator 106 to collect condensate). The separate modules 94 may be interconnected by decorative or structural moldings to give the appearance of a single merchandiser 78. In addition, the separate modules 94 may be interconnected to give the appearance of a single product display area 90. Alternatively, the merchandiser 78 may comprise a single module 94, or the merchandiser 78 may comprise more then two interconnected modules 94. For purposes of description only, a single merchandiser module 94 will be described herein.

Figure 3:
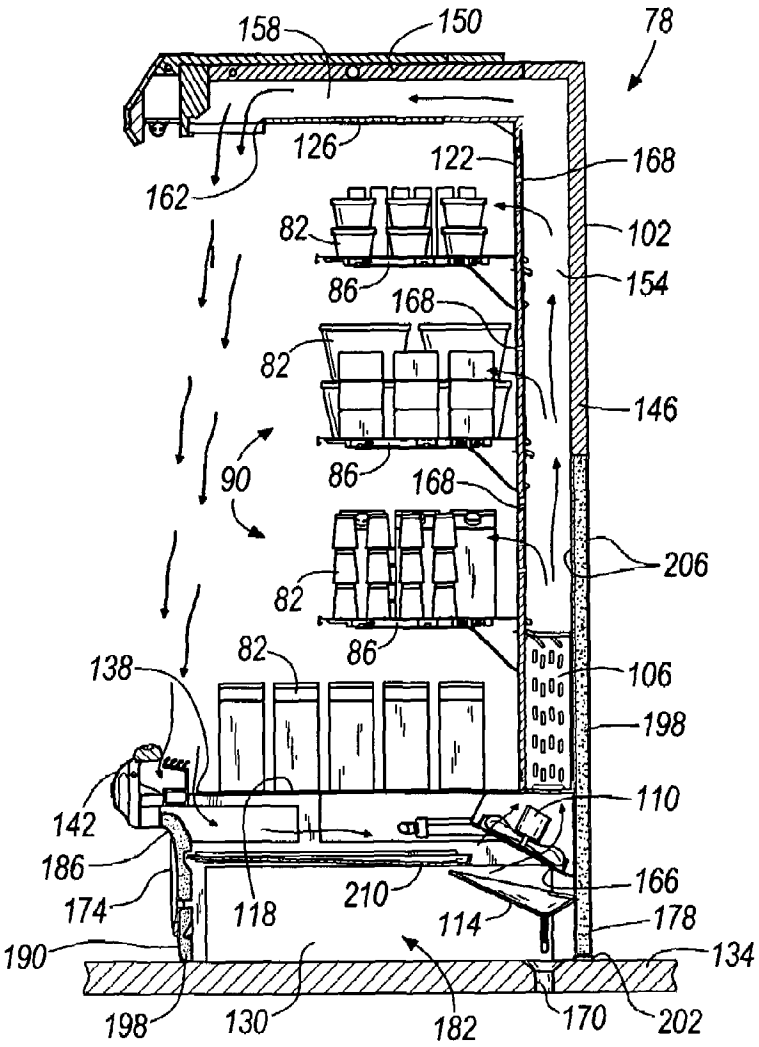
FIG. 3 is a cross-sectional view of the merchandiser of FIG. 1 through section line 3—3.

With reference to FIG. 3, the internal components of the merchandiser 78 are more clearly illustrated. The merchandiser case 102 includes an interior bottom wall or shelf 118, an interior rear wall 122, and an interior top wall 126. The area bounded by the interior bottom shelf 118, interior rear wall 122, and the interior top wall 126 defines the product display area 90. The case 102 includes an open front face to allow customers access to the refrigerated products 82 stored in the case 102.

A lower flue 130 is generally defined between the interior bottom shelf 118 and a support surface 134 supporting the merchandiser 78 to allow for substantially horizontal airflow throughout the lower flue 130 from the product display area 90. The interior bottom shelf 118 at least partially defines an opening 138 in the case 102 to communicate with the lower flue 130 to allow surrounding air to be drawn into the lower flue 130. In the illustrated construction, the opening 138 is substantially defined between the forward edge of the bottom shelf 118 and a cart bumper 142 of the case 102. Alternatively, the bottom shelf 118 may extend further toward the cart bumper 142 and provide a plurality of apertures therethrough to communicate the lower flue 130 with the surrounding air.

The case 102 also includes an exterior rear wall 146 adjacent the interior rear wall 122, and an exterior top wall 150 adjacent the interior top wall 126. A rear flue 154 is defined between the interior and exterior rear walls 122, 146, and is fluidly connected with and adjacent to the lower flue 130. The rear flue 154 allows for substantially vertical airflow throughout the rear flue 154. An upper flue 158 is defined between the interior and exterior top walls 126, 150 and is fluidly connected with and adjacent to the rear flue 154. The upper flue 158 allows for substantially horizontal airflow throughout the upper flue 158. The interior top wall 126 includes an opening 162 to communicate with the upper flue 158 and to allow airflow in the upper flue 158 to be discharged from the upper flue 158 into the product display area 90. When combined, the lower flue 130, the rear flue 154, and the upper flue 158 comprise an air passage separate from the product display area 90.

The refrigerated merchandiser 78 also includes some components of a refrigeration system (not entirely shown) therein. A fan 110 is located within the lower flue 130 toward the back of the case 102 to generate an airflow through the lower, rear, and upper flues 130, 154, 158. In the illustrated construction, the fan 110 is positioned in a fan housing 166. An evaporator 106 is located within the rear flue 154 toward the bottom of the case 102. The evaporator 106 is positioned downstream of the fan 110 such that the airflow generated by the fan 110 passes through the evaporator 106 to be cooled. Alternatively, the fan 110 may be positioned downstream of the evaporator 106, such that the fan 110 is operable to draw an airflow through the evaporator 106.

The resulting refrigerated airflow may then pass upwardly through the rear flue 154 to be either discharged through apertures 168 in the interior rear wall 122, or continue to the upper flue 158 to be discharged as the air curtain. The air curtain may return to the case 102 through the opening 138 and into the lower flue 130 for recirculation. The merchandiser 78 may also include a drain pan 114 positioned below the evaporator 106 to collect condensate formed on the evaporator 106 and/or melting frost, and route the collected condensate and/or melting frost to a drain 170. The drain pan 114 may be made from a plastic material by a process such as, for example, vacuum forming.

With continued reference to FIG. 3, the merchandiser 78 is substantially different than the prior-art merchandiser 10 of FIG. 1. For example, the foam tub 74 of the merchandiser 10 of FIG. 1 is not present in the merchandiser 78 of the present invention. This provides increased access to the support surface 134 beneath the merchandiser 78 for cleaning.

However, to make up for the insulating effect of the foam tub 74 in the bottom of the case 102, the merchandiser 78 of the present invention utilizes an insulating front panel 174 and an insulating rear panel 178 that extend toward and contact the support surface 134. In combination with the support surface 134 and the interior bottom shelf 118, the front and rear panels 174, 178 provide a substantially insulated space 182 in the bottom of the case 102. As a result, outside air is substantially prevented from entering the insulated space 182, and therefore prevented from rising and heating the refrigerated products 82 in the product display area 90, especially those products 82 situated on the interior bottom shelf 118.

Figure 4A:
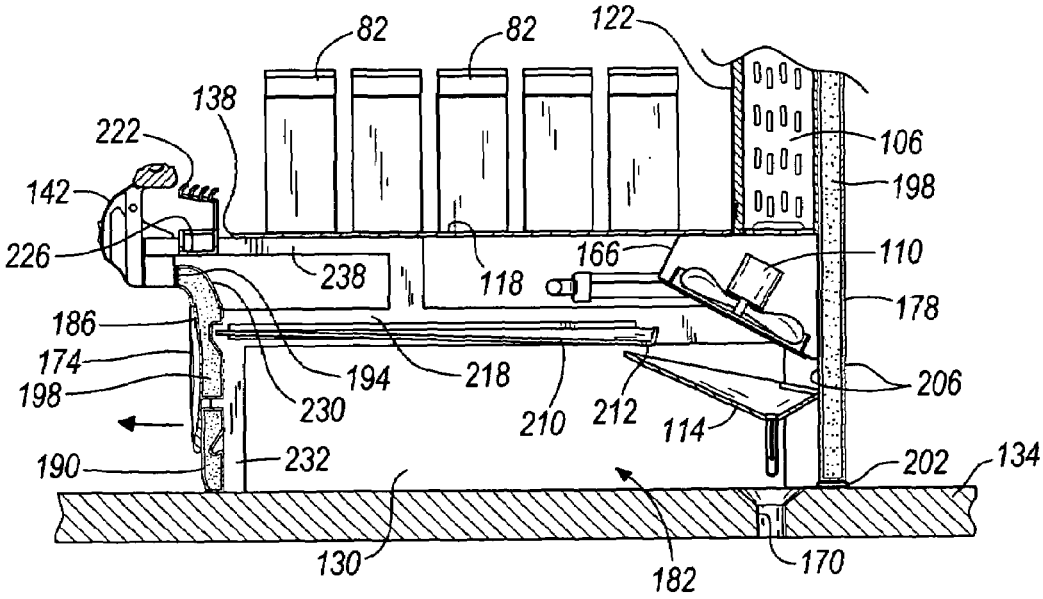
FIG. 4*a* is an enlarged view of the merchandiser of FIG. 3, illustrating a front panel and a removable container.

With reference to FIG. 4*a*, the front panel 174 includes an upper portion 186 and a lower portion 190 movably connected to the upper portion 186. The upper portion 186 of the front panel 174 includes an elastomeric, insulating strip or seal 194 at a distal end thereof to seal against the cart bumper 142 of the merchandiser 78. The insulating seal 194 runs the length of the front panel 174 to substantially prevent outside air from entering the insulated space 182 between the cart bumper 142 and the front panel 174. The insulating seal 194 may comprise any of a number of conventional elastomeric seals.

The lower portion 190 of the front panel 174 is biased in a direction toward the support surface 134 (as shown in FIG. 4*a*) by a bellows-type mechanism (not shown). The lower portion 190 may include an insulating strip or seal (not shown) coupled to a distal end thereof to seal against the support surface 134. The lower portion 190 is movably adjustable with respect to the upper portion 186 to ensure an adequate seal between the front panel 174 and the support surface 134 when, for example, the merchandiser 78 is positioned on an uneven support surface 134.

The upper and lower portions 186, 190 of the front panel 174 are substantially hollow and formed from plastic by a process such as blow-molding. Alternatively, other manufacturing processes may be utilized, and other materials may be utilized in manufacturing the front panel 174. To enhance the insulating properties of the front panel 174, foam insulation 198 may be added inside one or both of the upper and lower portions 186, 190 of the front panel 174.

With continued reference to FIG. 4*a*, the rear panel 178 is formed of a singular piece and includes an insulating strip or seal 202 coupled to a distal end thereof to seal against the support surface 134. The seal 202 may be substantially the same as the seals 194 coupled to the front panel 174. The rear panel 178 also includes foam insulation 198 sandwiched by sheets of metal 206 to enhance the insulating properties of the rear panel 178.

Figure 5:
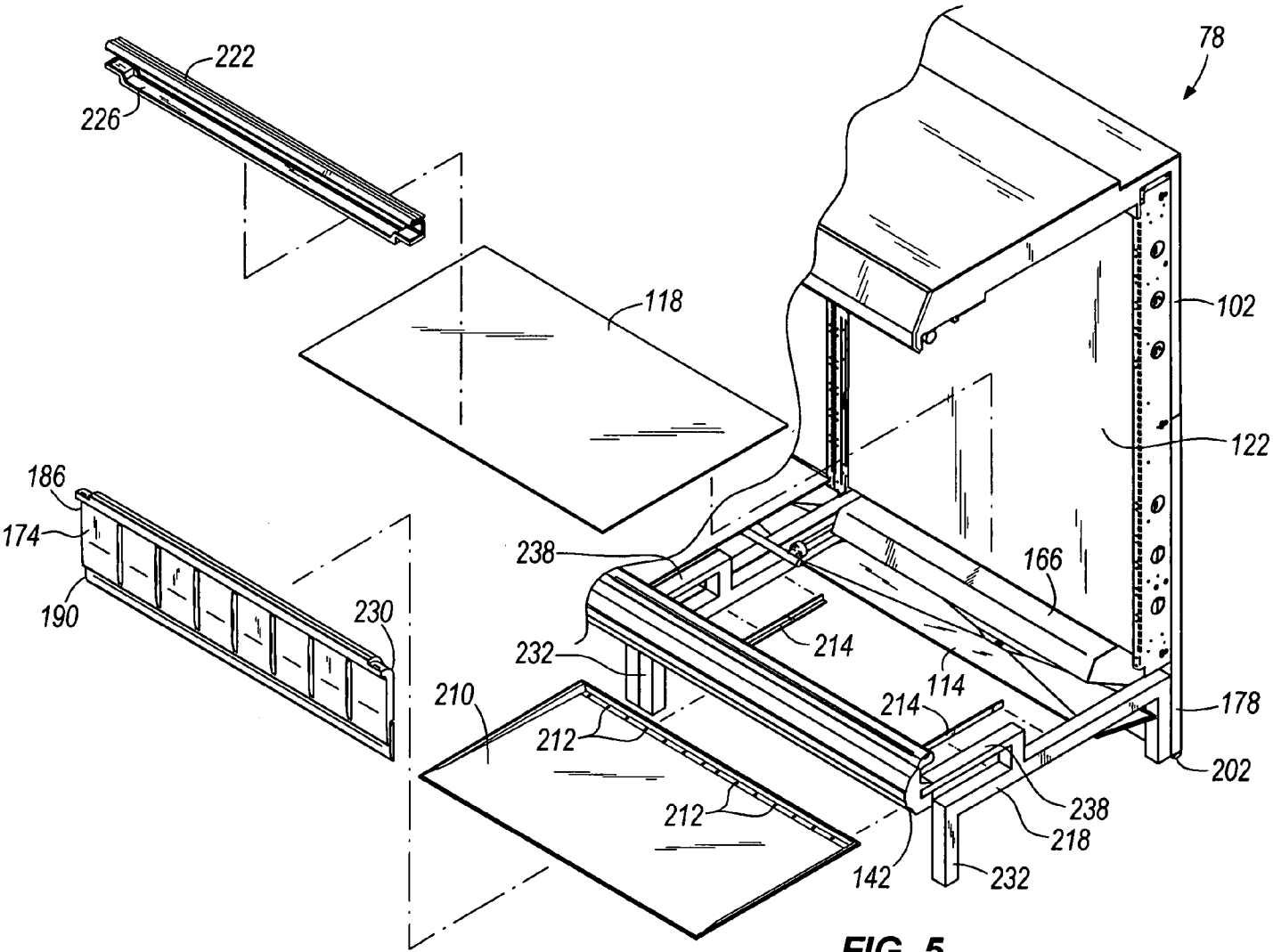
FIG. 5 is an exploded, enlarged view of the merchandiser of FIG. 2, illustrating access to the support surface of the merchandiser.

With reference to FIG. 5, the merchandiser 78 includes a removable container, or tray 210, positioned below the bottom shelf 118 to catch debris falling from the product display area 90. The tray 210 may be made from a plastic material by a process such as, for example, vacuum forming. Debris accumulated in the tray 210 may include, for example, spilled liquids (e.g., milk, orange juice, carbonated beverages, and so forth) and/or solid or particulate products spilled from damaged or broken containers. Such debris may end up accumulated on the tray 210 by falling and/or being swept from the bottom shelf 118, through the opening 138, and into the lower flue 130. In addition, dust and/or lint carried by the circulated airflow generated by the fan 110 may also accumulate in the tray 210. The tray 210 may include one or more apertures 212 to allow liquid debris to drain from the tray 210 and into the drain pan 114, where it is further routed to the drain 170.

By supporting the tray 210 below the bottom shelf 118, debris is substantially prevented from accumulating on the support surface 134. The tray 210 is supported below the bottom shelf 118 by a pair of opposing L-shaped brackets 214. The brackets 214 may be coupled to the inside surfaces of respective frame rails 218 providing the support structure of the merchandiser 78. The brackets 214 may be coupled to the frame rails 218 using conventional methods (e.g., fastening, welding, snap-fitting, and so forth). The brackets 214 may each include a sliding surface to support opposing edges of the tray 210. Since the tray 210 is easily removable, the tray 210 may be removed to dispose of any debris accumulated on the tray 210 and be cleaned.

A removable air grill 222 is supported by the case 102 in the opening 138 at a location adjacent the bottom shelf 118 and the cart bumper 142 such that the return air from the air curtain may pass by the air grill 222 before passing through the opening 138. The air grill 222 also helps to prevent debris from accumulating on the support surface 134 by providing a trough portion 226 positioned below the level of the bottom shelf 118. As a result, debris swept or falling from the bottom shelf 118 through the opening 138 may be collected by the trough portion 226 rather than falling to the support surface 134. The air grill 222 may also be removed from the case 102 for disposal of accumulated debris in the trough portion 226 and cleaning.

After passing by the air grill 222, the return air from the air curtain impinges upon an arcuate back portion 230 of the front panel 174. The arcuate back portion 230 is shaped to redirect the return air to a flow path substantially between the tray 210 and the bottom shelf 118. The tray 210 is sufficiently long such that the flow path leads to the inlet of the fan 110. Although the lower flue 130 is generally defined between the bottom shelf 118 and the support surface 134, most of the airflow occurs in the flow path between the bottom shelf 118 and the tray 210. However, the tray 210 is not required to direct the return air from the air curtain to the inlet of the fan 110. In absence of the tray 210, the airflow throughout the lower flue 130 occurs in the flow path between the bottom shelf 118 and the support surface 134.

Figure 4B:
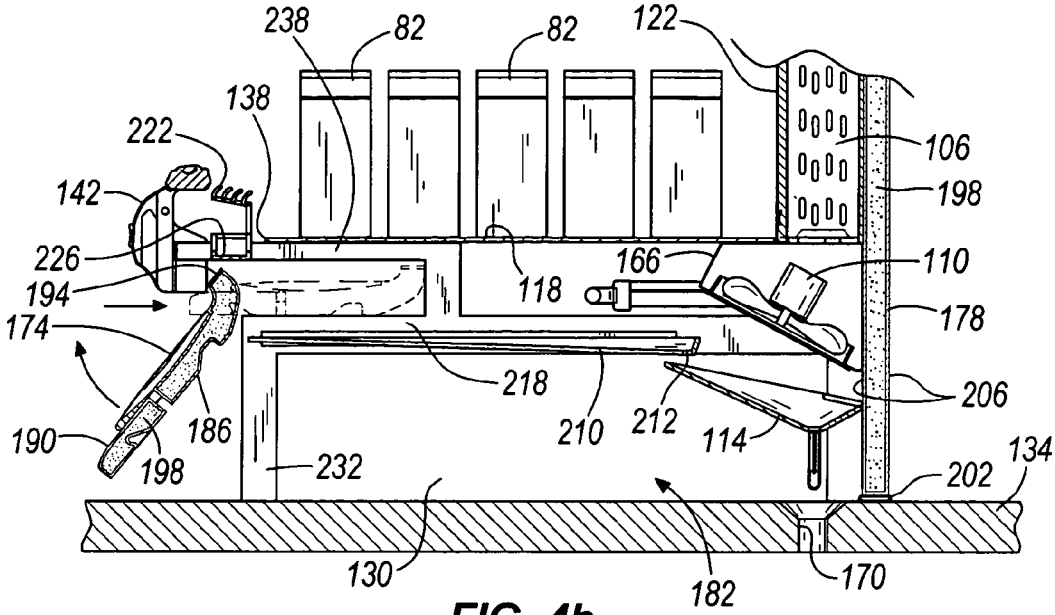
FIG. 4*b* is an enlarged view of the merchandiser of FIG. 3, illustrating the front panel being detached from the merchandiser.
Figure 4C:
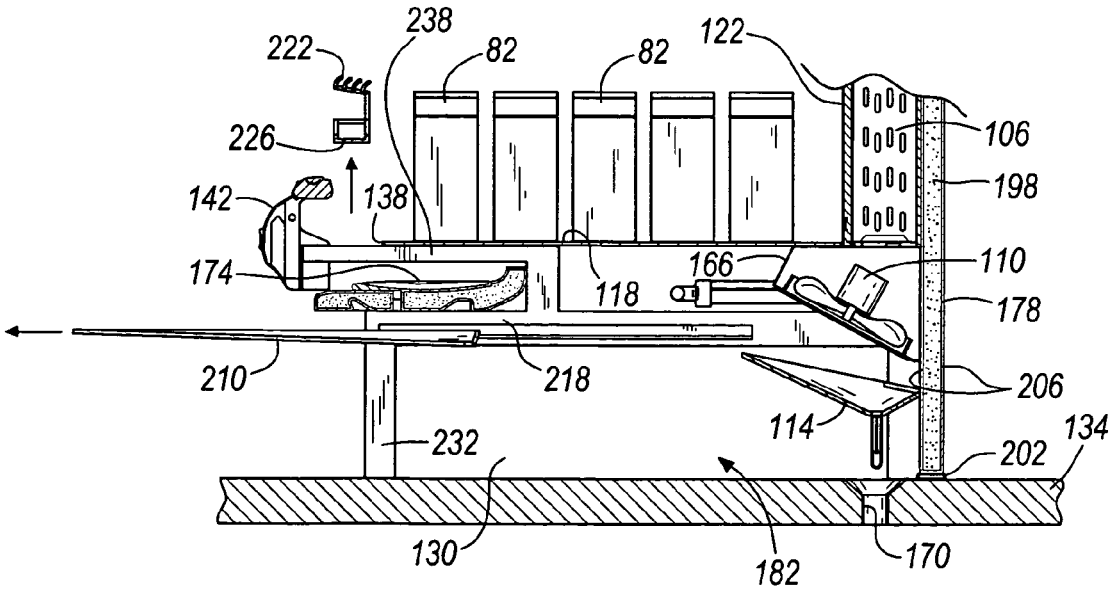
FIG. 4*c* is an enlarged view of the merchandiser of FIG. 3, illustrating the front panel in its stored position, the container being removed from the merchandiser, and an air grill being removed from the merchandiser.

With reference to FIGS. 4*b*–4*c*, the front panel 174 is detachable from the case 102 to provide access to the tray 210 for removal. The front panel 174 may include locking structure (not shown) to inter-engage mating locking structure (not shown) on front frame members 232 to maintain the front panel 174 in a deployed position. To detach the front panel 174, it may be pulled from the front frame members 232 to disengage the inter-engaging locking structures. The front panel 174 may then be placed on the support surface 134 away from the merchandiser 78, or more preferably, the front panel 174 may be inserted into a slot defined between parallel frame rails 218, 238 (see FIG. 4*c*) to maintain the front panel 174 in a stored position while emptying and/or cleaning the tray 210. Alternatively, the front panel 174 may utilize sliding and/or pivoting joint structure to allow the front panel 174 to be pivoted upward from its deployed position and slid into its stored position in the slot between the frame rails 218, 238. Such sliding and/or pivoting joint structure may be coupled to the cart bumper 142 or another stationary portion of the merchandiser 78.

While the front panel 174 is in the stored position, access to the insulated space 182 and the support surface 134 below the merchandiser 78 is provided for cleaning. As a result, a broom or other cleaning device may be used to clean the support surface 134 below the merchandiser 78 without having to remove any products 82 from the product display area 90. In the merchandiser 10 of FIG. 1, the products must be removed from the merchandiser 10, and the merchandiser 10 must be moved to adequately clean the support surface below the merchandiser 10.

In addition, while the front panel 174 is in the stored position, access to the fan 110 and fan housing 166 is provided through the insulated space 182 without having to remove any products 82 from the product display area 90. As a result, maintenance and/or replacement of the fan 110 may be performed without removing any products 82 from the product display area 90. In the merchandiser 10 of FIG. 1, the products on the bottom shelf 18 must be removed and stored, and the bottom shelf 18 removed to gain access to the fan 66.

It should be known that the merchandiser 78 may be utilized without the tray 210, such that debris falling from the bottom shelf 118 may be allowed to accumulate on the support surface 134. Further, the support surface 134 may be accessible through the front panel 174 for cleaning. In addition, the merchandiser 78 may incorporate a foam tub similar to the foam tub 74 of the prior-art merchandiser 10 while utilizing the tray 210, which may be positioned between the bottom shelf 118 and the foam tub to collect debris falling from the bottom shelf 118.

Although FIGS. 2–5 illustrate the merchandiser 78 as an open-faced merchandiser that would typically be positioned against a wall, the merchandiser 78 of the present invention may also include any of a number of different forms of merchandisers (e.g., an island merchandiser, a convertible merchandiser, a service merchandiser, and so forth). In one alternate construction, for example, the merchandiser 78 may be an island merchandiser (not shown), such that the front and back portions of the island merchandiser are substantially the same. In such an island merchandiser, both front and back insulating panels may be removable to gain access to a removable tray positioned below the bottom shelf. In addition, the removable front and back panels may provide access to the support surface beneath the island merchandiser for cleaning. Further, the removable front and back panels may provide access to the refrigeration components of the island merchandiser, such as the fan and/or the evaporator.

I claim:

1. A refrigerated merchandiser adapted to display refrigerated products, the merchandiser comprising:

a case defining a product display area;

a bottom shelf adapted to support the refrigerated products within the product display area;

a panel movably coupled with the case at a location below the bottom shelf; and a container removably coupled with the case at a location below the bottom shelf and adapted to collect debris falling below the bottom shelf, the container removable from the case for cleaning without removing the refrigerated products from the bottom shelf, the container removable from the case independent of the panel.

2. The refrigerated merchandiser of claim 1, wherein the panel is selectively movable to allow access to the container.

3. The refrigerated merchandiser of claim 1, wherein the panel includes an insulating material.

4. The refrigerated merchandiser of claim 1, wherein the panel is movable between a stored position, in which the panel is positioned above the container, and a deployed position, in which a lower end of the panel is in contact with a support surface supporting the case.

5. The refrigerated merchandiser of claim 1, wherein the panel comprises a first panel, the merchandiser further comprising a second panel coupled to the case opposite the first panel, the second panel including a lower end in contact with a support surface supporting the case.

6. The refrigerated merchandiser of claim 5, wherein a substantially enclosed space is defined by the bottom surface, the support surface, and the first and second panels, the space being selectively accessible through the first panel to allow cleaning of the support surface beneath the case and to have access to a fan positioned in the space without removing the refrigerated products from the lower shelf.

7. A refrigerated merchandiser adapted to dispiay refrigerated products, the merchandiser comprising:

a case defining a product display area;

a bottom shelf adapted to support the refrigerated products within the product display area;

a container removably coupled with the case at a location below the bottom shelf and adapted to collect debris falling below the bottom shelf, the container removable from the case for cleaning without removing the refrigerated products from the bottom shelf;

an aperture through the container to allow collected debris to fall therefrom; and a drain pan below the bottom shelf and the container to receive fallen debris from the container, the drain pan being adapted to guide the debris into a drain.

8. A refrigerated merchandiser adapted to display refrigerated products, the merchandiser comprising:

a case defining a product display area;

a bottom shelf adapted to support the refrigerated products within the product display area;

a first insulating panel movably coupled to the case, the first insulating panel having a lower end in contact with a support surface supporting the case;

a second insulating panel coupled to the case opposite the first insulating panel, the second insulating panel having a lower end in contact with the support surface such that a substantially enclosed space is defined by the bottom shelf, the support surface, and the first and second insulating panels; and a fan positioned in the space, wherein the fan is accessible via the movable first insulating panel for maintenance without removing the refrigerated products from the bottom shelf.

9. The refrigerated merchandiser of claim 8, wherein the space is selectively accessible to allow cleaning of the support surface beneath the case.

10. The refrigerated merchandiser of claim 9, wherein the first insulating panel is movable to allow access to the space.

11. The refrigerated merchandiser of claim 8, further comprising a container removably coupled with the case at a location below the bottom shelf and adapted to collect debris falling below the bottom shelf.

12. The refrigerated merchandiser of claim 11, wherein the first insulating panel is movable to allow access to the container without removing the refrigerated products from the bottom shelf.

13. The refrigerated merchandiser of claim 8, wherein the first insulating panel is movable between a stored position, in which the first insulating panel is positioned above the container, and a deployed position, in which the lower end of the first insulating panel is in contact with the support surface.

14. A refrigerated merchandiser adapted to display refrigerated products, the merchandiser comprising:

a case defining a product display area;

a bottom shelf adapted to support the refrigerated products within the product display area;

a fan supported by the case below the bottom shelf and operable to generate an airflow in the case through an evaporator and through the product display area;

a panel movably coupled with the case, the panel being selectively movable to allow access to the fan for maintenance without removing the refrigerated products from the bottom shelf; and a container removably coupled with the case at a location below the bottom shelf and adapted to collect debris falling below the bottom shelf.

15. The refrigerated merchandiser of claim 14, wherein the panel is movable between a stored position, in which the panel is oriented substantially parallel with the bottom shelf, and a deployed position, in which a lower end of the panel is in contact with a support surface supporting the case.

16. The refrigerated merchandiser of claim 15, wherein the panel includes insulating material.

17. The refrigerated merchandiser of claim 14, wherein the panel is selectively movable to allow access to the container without removing the refrigerated products from the bottom shelf.

18. A refrigerated merchandiser adapted to display refrigerated products, the merchandiser comprising:

a case defining a product display area;

a bottom shelf adapted to support the refrigerated products within the product display area;

a fan supported by the case below the bottom shelf and operable to generate an airflow in the case and through the product display area;

a first panel movably coupled with the case, the first panel being selectively movable to allow access to the fan for maintenance without removing the refrigerated products from the bottom shelf, the first panel including a lower end in contact with a support surface supporting the case; and a second panel coupled to the case opposite the first panel, the second panel including a lower end in contact with the support surface.

19. The refrigerated merchandiser of claim 18, wherein the first and second panels each include insulating material.

20. The refrigerated merchandiser of claim 18, wherein the bottom shelf, the support surface, and the first and second panels define a substantially enclosed space that is selectively accessible to allow cleaning of the support surface beneath the case.

21. The refrigerated merchandiser of claim 20, wherein the first panel is movable to allow access to the space.

* * * * *